United States Patent [19]

Weiss et al.

[11] 4,316,721

[45] Feb. 23, 1982

[54] METHOD FOR PRODUCING A THRUST IN MANOEUVERING ENGINES FOR A WATERCRAFT AND A MANOEUVERING ENGINE CONSTRUCTED FOR THE SAME

[75] Inventors: Friedrich Weiss, Ahrensburg; Fred Petersen, Hamburg, both of Fed. Rep. of Germany

[73] Assignee: Jastram-Werke GmbH KG, Hamburg, Fed. Rep. of Germany

[21] Appl. No.: 924,666

[22] Filed: Jul. 14, 1978

[30] Foreign Application Priority Data

Jul. 16, 1977 [DE] Fed. Rep. of Germany ..... 2732223
Jun. 29, 1978 [DE] Fed. Rep. of Germany ... 7819548[U]

[51] Int. Cl.[3] ..... B63H 11/02

[52] U.S. Cl. ..... 440/47; 440/38; 60/221; 417/177; 239/265.19

[58] Field of Search ..... 239/265.11, 265.19, 239/265.13, 380, 451, 461; 114/151; 244/206; 115/11, 12 R, 12 A, 14, 15, 39, 42; 60/221, 222; 417/177; 440/38–47

[56] References Cited

U.S. PATENT DOCUMENTS

| | | | |
|---|---|---|---|
| 2,788,635 | 4/1957 | Ford | 239/265.19 |
| 3,163,980 | 1/1965 | Turner | 60/221 |
| 3,315,940 | 4/1967 | Hordley | 239/265.19 |
| 3,358,453 | 12/1967 | Swet | 60/222 |
| 3,448,714 | 6/1969 | Brooks | 244/206 |
| 3,606,586 | 9/1971 | Piet | 417/177 |
| 3,620,183 | 11/1971 | Hull | 114/151 |
| 3,834,626 | 9/1974 | Sevik | 239/265.13 |

*Primary Examiner*—Trygve M. Blix
*Assistant Examiner*—D. W. Keen
*Attorney, Agent, or Firm*—Toren, McGeady & Stanger

[57] ABSTRACT

The invention relates to a method for producing a thrust in manoeuvering engines for watercraft and a manoeuvering engine constructed for the same, whereby the method comprises the annular driving water jet supplied to the diffuser and enveloping a first suction water jet is fed to a second suction water jet supplied to the diffuser inner wall surface, while the manoeuvering engine is constructed in such a way that the rear part of the engine casing is provided with an inlet port having a smaller diameter than the outlet port and located in the vicinity of the outlet port of the front engine part, whereby for the optimum adaptation of the exit mixing jet velocity to the vehicle speed a water jet exit cross-section regulating device is provided.

13 Claims, 12 Drawing Figures

Figure 1:
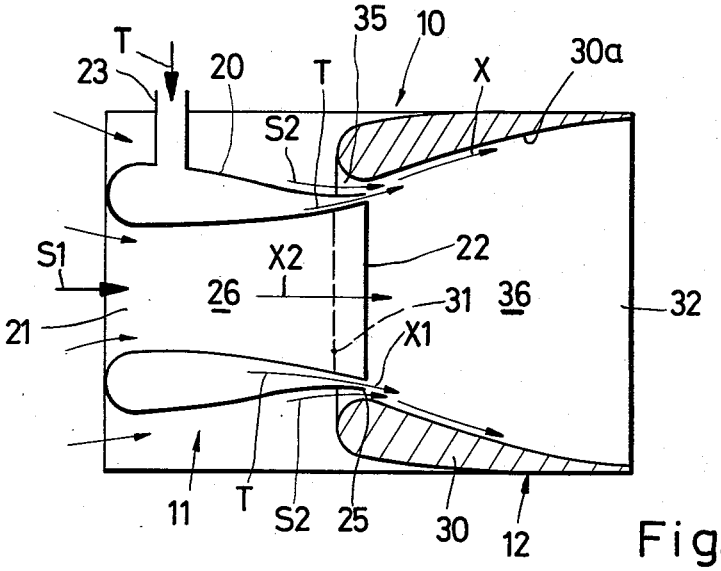
Figure 2A:
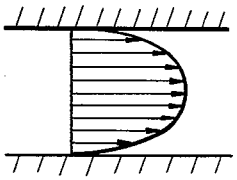
Figure 2B:
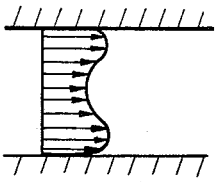
Figure 2C:
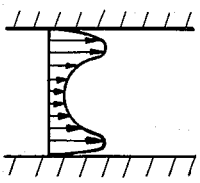

METHOD FOR PRODUCING A THRUST IN MANOEUVERING ENGINES FOR A WATERCRAFT AND A MANOEUVERING ENGINE CONSTRUCTED FOR THE SAME

The invention relates to a method for producing thrust in manoeuvering engines for watercraft in which according to the drag jet principle driving water and suction water are supplied to a mixing section and a following diffuser section of the engine, and to a manoeuvering engine comprising a casing with a front part which is constructed as the suction section and having an annular duct which carries the driving water, whereby its inner area surrounded by the annular duct is provided at the front with an inlet port and with an outlet port for a suction water jet at the end opposite to the inlet port and which adjacent to the outlet port has a discharge slot for the driving water which surrounds the outlet port in annular manner, and with a rear part which is constructed as a divergent nozzle with an outlet port.

It is known to use a low-loaded axial flow pump for producing a thrust with the aid of a jet engine in watercraft. However, the attainable efficiency levels are already so high that improvements are scarcely possible. In the case of constant jet production efficiencies the attainable thrust or propulsive output is a question of the power loading of the jet production surface and the velocity. As a first approximation, velocity can be ignored as a criterion for manoeuvering engines, because the flow velocities are very low compared with the jet velocities in such engines. Propellor engines have specific advantages, but also serious disadvantages in many applications such as large diameter, the necessary adequate submergence, high conveyed mass, large control forces, heavy power transmission units, etc. Attempts to obviate these disadvantages have led to an ever more greatly loaded engine. With propellor engines, loads up to 370 $kW/m^2$ of jet surface are possible, but beyond this other pump types must be used. The jetspeeds attainable with single-stage propellor engines amounts to approximately 10 m/sec. This range can be increased to 20 m/sec with diagonal pumps. Jet speeds in excess of 50 m/sec can be achieved with radial pumps. In the jet production plane, the necessary working pressures are 0.5 to 20 bar.

The higher the jet production pressure and consequently the jet speed of the engine, the lower the adjusting power with a manoeuvering engine and the lower the water throughput. The greatest disadvantage is the fact that the thrust per kW rapidly decreases. Thus, an engine working with approximately 5 bar jet production pressure corresponding to a jet speed of approximately 30 m/sec only produces about 45 N of static thrust per kW of propulsive output.

This is the main reason why radial and diagonal pumps have been used to only a very limited extent in propulsion technology.

Efforts were therefore directed at eliminating or reducing the decisive disadvantage of high-loaded jet engines, i.e. the limited thrust levels, by a suitable construction of the jet exit devices. The first improvement was offered by the use of the ejector effect in which a high-loaded driving jet additionally sucks in water through a suitable mixing nozzle and is used to produce thrust. Such ejector actions have been tested and used in wind tunnel technology for high velocity wind tunnels.

Only of late has research been carried out by WITTE and LORENZ in the field of water jet engines.

The wind tunnel research carried out by WITTE with ejector engines was limited to ejectors with a central driving jet injection, whilst the research by LORENZ was based on the use of the ejector principle for transverse jet rudders and embraced both the multihole marginal jet ejector and the ejector with a slot-like driving jet exit over the full cross tube periphery. Ejector engines with a very great length compared with the suction tube diameter were used, which did not permit use as a rotary monoeuvering engine.

The known ejector engines comprise a suction tube with a rounded outlet, a mixing stage and a following diffuser. Into the suction tube issues a driving jet nozzle, which is either arranged in the inlet in the centre of the suction tube, or has a gap-like edge and is distributed over the suction tube periphery, or is in the form of individual nozzles distributed over the periphery.

The attempts to reduce the length of the engine could only be successful if it proved possible to shorten the mixing section or to eliminate it completely whilst, without losing efficiency, making the diffuser opening angle so large that a sufficiently large ratio of diffuser end face to suction tube face could be obtained with a short diffuser. A particularly advantageous efficiency level could be achieved if it proved possible to keep the wall surfaces in contact with the very rapid driving jet as small as possible or to eliminate them completely.

A central jet ejector necessarily leads to a flow profile in the suction tube which permits only very small diffuser opening angles. If the opening angle is more than 3%, the diffuser efficiency rapidly collapses. The contact between the rapid driving jet and a wall face is limited to the nozzle outlet. The ejector wall is only subject to the action of the mixing speed. However, as in the known long ejectors, the wall faces are very long, this once again has the action of significantly reducing the efficiency of the engine due to wall friction.

The marginal jet ejector according to LORENZ and its modification as a multihole ejector lead to a flow profile in the suction tube permitting both very short mixing lengths and larger diffuser angles, thus permitting shorter overall lengths of the engine. However, the disadvantage thereof is that extensive suction tube faces are subject to the action of the full driving jet speed, so that due to the resulting wall friction, a large proportion of the engine thrust is lost. A length extending beyond that necessary for the function, as can be necessary with a cross tube in a ship due to the width of the latter, leads to a considerable additional loss of thrust.

In general, watercraft are driven by water jet engines in the widest sense. These include propellers, which can be considered as extremely low-loaded axial flow pumps.

Even the basic laws of physics which have to be taken into consideration when designing a water jet engine, indicate the most advantageous construction. In order to obtain a high thrust and good efficiency, the engine must bring about the minimum acceleration of the maximum quantity of water.

Marine screw propellers can hardly be improved upon in this respect, hence the wide use of this propulsion member. However, in certain applications screw propellers have serious disadvantages. They have a large diameter against which there must be a maximum free flow, so that they have an enormous space requirement and require a special construction of the underwater part of the craft. To avoid inrush of air and cavitation, screw propellers must also be adequately submerged. Further disadvantages are heavy load transmission units, high control forces when constructed as a manoeuvering engine, serious vibration source, high source of noise, etc. If these disadvantages are to be obviated, this necessarily leads to high-loaded engines, i.e. to diagonal or radial pumps. The latter make it possible to reach jet velocities above 50 m/sec, whereby such an installation is relatively small and light-weight. The disadvantage thereof is that in the case of low speeds of the craft the ratio of thrust to propulsive output is very small due to the great difference between the jet velocity and the craft speed. Thus, for example, on a static basis with a jet velocity of 30 m/sec only 60 m of thrust per kW of propulsive output can be produced, whereas a screw propeller operating with 6 m/sec jet velocity reaches 333 N/kW (ideal calculation: jet thrust/jet capacity=2/jet velocity). This is the reason why radial and diagonal pumps have only been used to a very limited extent in propulsion technology. With a conventional construction, they are only of interest i.a. for high speed vehicles (hydrofoils and hovercraft), whose initial velocity is already close to the jet velocity.

The problem of the present invention is to provide a manoeuvering engine with a high thrust and an advantageous efficiency for watercraft, which permits an optimum adaptation of the jet exit velocity and the ratio of driving water to suction water to any random craft speed, without significantly increasing the engine length, and to provide a method for obtaining this high thrust in which the wall surfaces of the engine in contact with the very rapid driving water jet are kept very small or are eliminated completely and in which an optimum flow profile is obtained with a short mixing length and a large diffuser angle.

The method proposed for solving this problem comprising the suction water is subdivided into two flow portions, whereof the first suction water jet is enveloped by the annular driving water jet, whilst the second suction water jet externally envelopes the driving water jet, whereby in detail the central suction water jet is supplied to a suction section and in the outlet region of said suction section and in the immediately following diffuser section with a somewhat larger diffuser section inlet region than the suction section outlet region a driving water jet which surrounds in annular manner the central section water jet is supplied to the diffuser region with a slight widening towards the lateral boundary surface of the diffuser section whereby, whilst excluding contact with the diffuser section lateral boundary surface, the driving water jet is supplied to the second suction water jet fed in annular manner into the annular clearance formed between the suction section outlet region and the diffuser section inlet region.

According to the invention, the manoeuvering engine proposed for solving the problem is characterised in that the rearward part of the engine casing is provided with an inlet port having a smaller diameter than the diameter of the outlet port and which closest cross-section is arranged approximately in the area of the outlet port of the front engine part and has a larger diameter than the outlet port with the formation of an annular intake slot surrounding the discharge slot of the annular duct for a further suction water jet.

Thus, a manoeuvering engine is provided which has a small total length with high thrust efficiency and in which the diffuser wall surfaces are not in contact with the very rapid driving water jet. In this engine, the full driving jet velocity does not act on the ejector wall, as is the case with a marginal jet ejector. In addition, an optimum flow profile accompanied by short mixing length and a large diffuser angle is achieved, i.e. the wall surfaces subject to friction are very small. This construction of the engine permits its use as a rotary manoeuvering engine and in particular this is due to the short length of the actual engine. The manoeuvering engine permits the conversion of a high velocity jet of small volume into a jet with a low absolute velocity and correspondingly larger volume. To achieve this low jet velocity, the manoeuvering engine is constructed in such a way that an extremely large quantity of water is passed through, whereby the high capacity diffuser section of the engine ensures an optimum extensive conversion of the velocity energy into pressure energy and consequently into thrust.

Furthermore, the invention relates to a manoeuvering engine constructed in such a way that for the optimum matching of the velocity of the mixing jet coming from the engine to the speed of the craft, a device for regulating the water jet exit cross-section or for modifying the inlet cross-section of the outer suction water jet enveloping the driving water jet is provided in the engine.

On the basis of the construction of a manoeuvering engine according to the invention, the decisive disadvantage of the high-loaded jet drives is compensated, whilst retaining the advantages. Through a suitable construction of the engine, an optimum adaptation of the quantity of water passed through and the jet velocity to the speed of the craft can be obtained.

This device for regulating the water jet exit cross-section comprises a conically shaped filling body axially symmetrical to the engine axis and arranged in the inner area of the diffuser of the engine, accompanied by the formation of an annular exit cross-section between the diffuser inner wall and the filling body determinable by the particular position of said filling body. In order to bring about the change in the exit cross-section, the filling body is displaceable parallel to the engine axis by means of hydraulic, mechanical or motor-driven devices.

According to a further feature of the invention, the device for regulating the water jet exit cross-section or for modifying the inlet cross-section of the outer suction water jet enveloping the driving water jet is arranged in the central suction water jet of the engine.

According to a further development of the engine, the diffuser ring is displaceable with respect to the front part of the engine in the longitudinal direction of the latter, so that the inlet cross-section of the outer suction water jet enveloping the driving water jet is adjustable.

According to a further development of the manoeuvering engine according to the invention, a filling body made from flexible material constructed in spindle-like manner and which can be inflated in balloon-like manner with gas or a liquid and which is axially symmetrical to the engine axis is arranged in the front part of the engine and preferably at its rear end centrally in the central suction water jet, whereby an annular cross-section of passage, whose surface is adjustable through the filling volume of the inflatable filling body is formed between the inner wall of the front engine part surrounding the central suction water jet and the filling body.

According to another development of the invention, the diffuser part of the engine is constructed as an annular duct corresponding to the front part of the engine, whereby the inner surface of the diffuser part is provided with a plurality of openings and the annular duct is connected via a line provided with a regulating valve to the suction line of a driving water pump equipped with a regulating valve, so that the driving water pump via the diffuser ring duct is constructed so as to suck the boundary layer forming on the perforated diffuser inner wall through the latter, so that large diffuser opening angles are possible without flow separation, thereby permitting a short construction of the diffuser part and consequently of the entire engine.

Furthermore, swirl vanes can be arranged in the diffuser or in the front engine part. A swirling motion is given to the water flowing through the engine due to the arrangement of swirl vanes in the diffuser in the area of both suction water sections and/or in the annular driving water nozzle, so that large diffuser opening angles are possible without flow separation, thus permitting a short construction of the diffuser part and consequently of the entire engine.

According to another feature of the invention, the diffuser part of the engine comprises an annular duct having an almost circular cross-section which at its end remote from the front part of the engine is provided with a slot which is directed inwards towards the engine axis and through which water can be drawn into the inside of the annular duct, whilst the pump used is a driving water pump and the annular duct is connected via a line provided with a regulating valve to the suction line of the driving water pump also equipped with a regulating valve, whereby through a corresponding setting of the two regulating valves, it is possible to adjust the volume of water drawn through the annular slot and consequently the expansion of the jet discharged from the engine can be regulated.

A manoeuvering engine which is particularly suitable for fixed installation in or on watercraft with an angular constructional form is characterised in that the diffuser part of the engine is formed by rotors which laterally are tangential to the mixing jet whereby the rotors rotate in opposite directions and at the side in contact with the mixing jet rotate in the same direction as the flow and the expansion of the mixing jet can be regulated by means of the rotor speed, so that in the case of rotation in the same direction a deflector of the jet discharged from the engine is also possible.

A manoeuvering engine with the features of the invention permits an optimum adaptation of the jet exit velocity and the ratio of the driving water to the suction water to any random watercraft, without it being necessary to significantly increase the engine length. This adaptation is brought about by modifying the suction water inlet cross-section and/or the mixing water outlet cross-section.

The invention is described in greater detail hereinafter relative to non-limitative embodiments and with reference to the attached drawings, wherein show:

FIG. 1 a manoeuvering engine in a vertical longitudinal section.

FIGS. *2a, 2b, 2c* a comparison of the flow profiles of a central jet ejector, an annular jet ejector and a manoeuvering engine according to FIG. 1.

Figure 3:
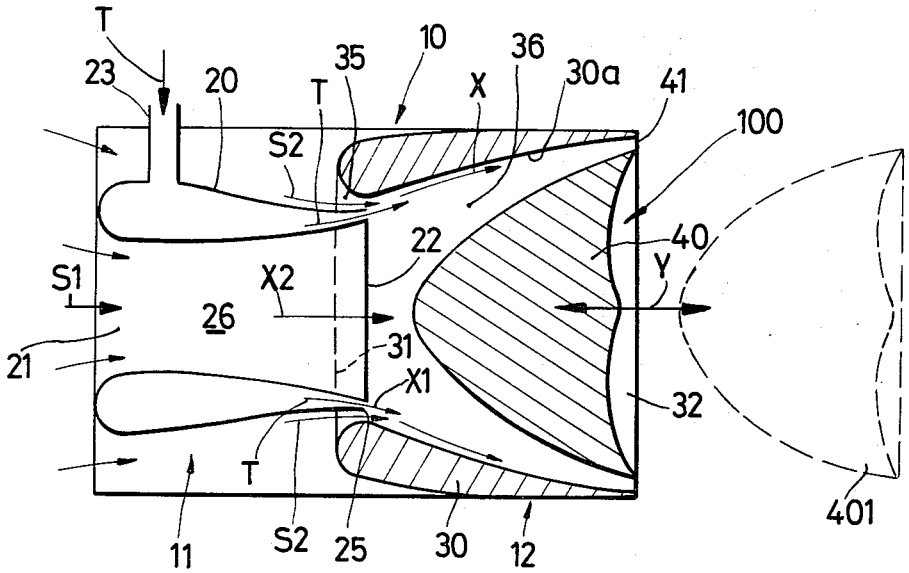

FIG. 3 a manoeuvering engine with an axially symmetrical filling body for outlet cross-section regulation displaceably arranged in the inner area of the diffuser.

Figure 4:
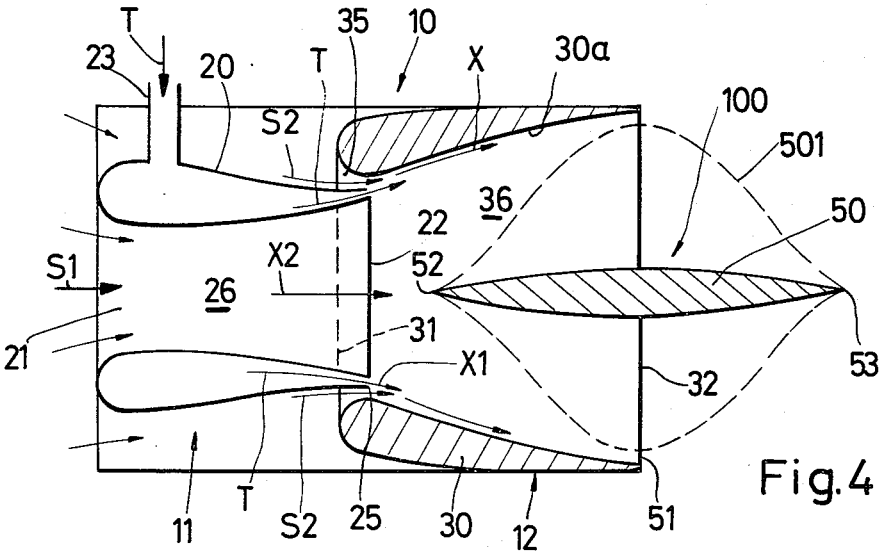

FIG. 4 a manoeuvering engine with a differently constructed filling body.

Figure 5:
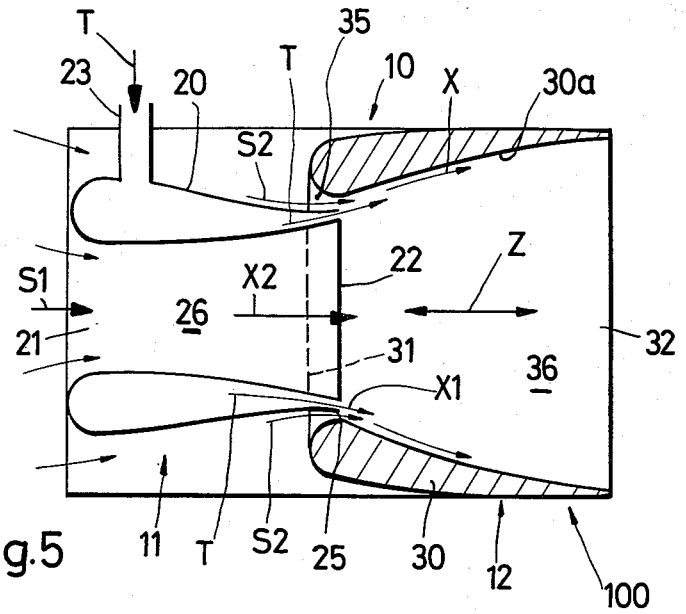

FIG. 5 a manoeuvering engine with a displaceable diffuser ring.

Figure 6:
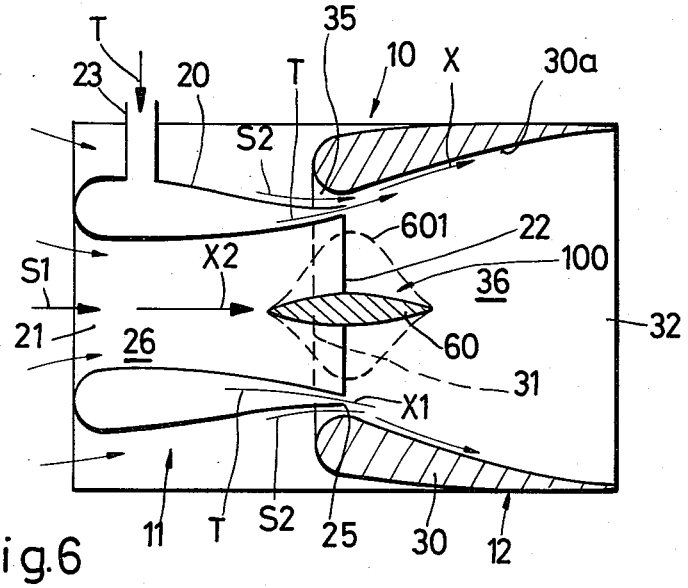

FIG. 6 a manoeuvering engine with a further constructional embodiment of an inflatable filling body.

Figure 7:
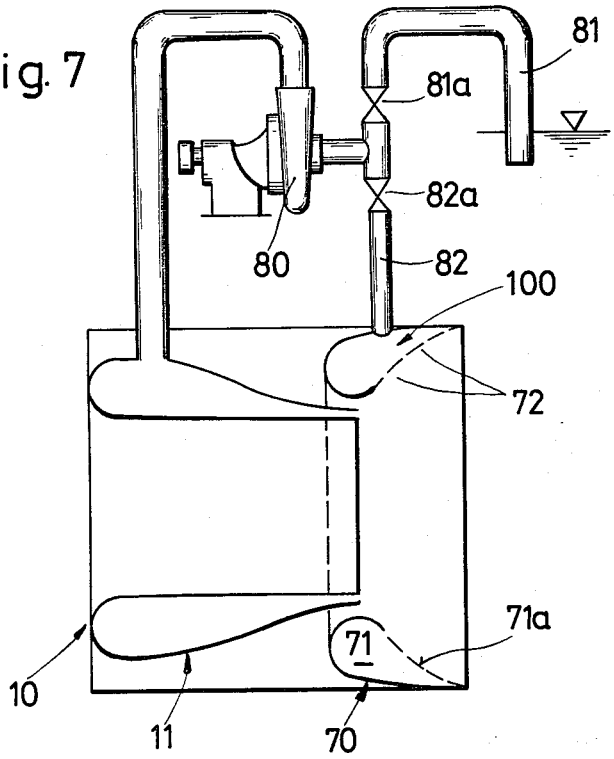

FIG. 7 a manoeuvering engine with a diffuser part in a construction which prevents layer separation.

Figure 8:
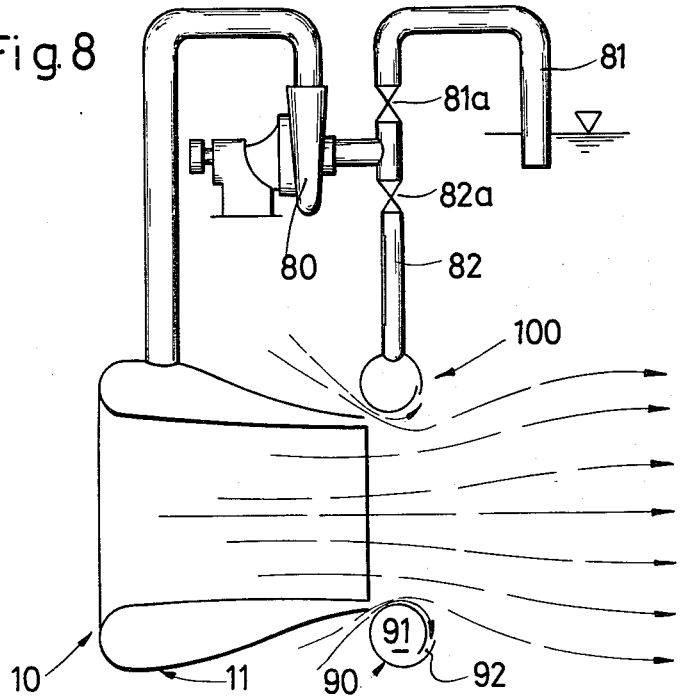

FIG. 8 a further embodiment of a short manoeuvering engine which, instead of a diffuser part, has an active device for jet expansion.

Figure 9:
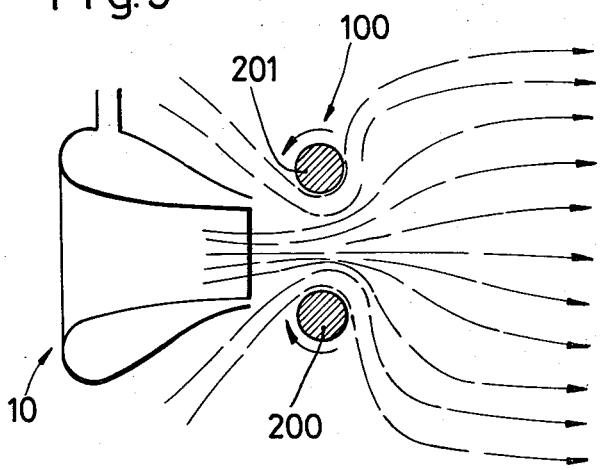

FIG. 9 a further embodiment of a manoeuvering engine with oppositely rotating rotors for jet expansion.

Figure 10:
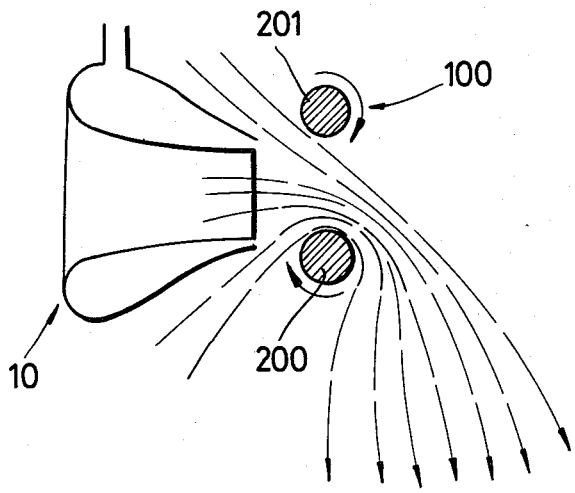

FIG. 10 a manoeuvering engine with rotors rotating the same direction.

The manoeuvering engine shown in the drawings is designated by the reference numeral 10 and comprises a front engine part 11 and a rear engine part 12.

The front engine part 11 is formed by an annular duct 20 which surrounds the engine inner area 26, so that a rounded inlet port 21 and an outlet port 22 are produced. Annular duct 20 is provided with a feed connection 23 for driving water T and has at the end remote from the rounded inlet port an annular slot 25 for the discharge of driving water T. The inner area 26 surrounded by annular duct 20 forms the suction section through which is passed a first suction water jet S1. The front engine part 11 is followed by the rear engine part 12 which constitutes the diffuser and which comprises a diffuser nozzle 30 with an inlet port 31 and an outlet port 32. The narrowest point of inlet port 31 of diffuser nozzle 30 has a larger diameter than the diameter of outlet port 22 of the front engine part 11, so that inlet port 31 is located in the plane formed by the outlet port 22 of the front engine part 11, accompanied by the formation of an annular slot 35 which embraces the annular slot 25 for the admission of driving water T.

The annular admission slot 35 serves to supply a second suction water jet S2 to the inner area 36 of diffuser nozzle 30. The overall arrangement of the front engine part 11 and the rear engine part 12 is such that the suction water jet S2 entering the annular admission slot 35 is passed to the inner wall surface 30*a* of diffuser nozzle 30 in the direction of arrow X. The inner area 36 of diffuser nozzle 30 widens conically towards the outlet port 32, so that the diameter of outlet port 32 is larger than the narrowest diameter of the inlet port 31 of diffuser nozzle 30.

The annular discharge slot 25 in the front engine part 11 is so constructed with reference to its guide surfaces that the driving water jet T discharged from annular discharge slot 25 in the direction of arrow X1, in the case of a simultaneous flow-through of suction water jet S1 in the direction of arrow X2 through the engine does not strike the inner wall surface 30*a* of the diffuser nozzle and instead meets the suction water jet S2 passed along the inner wall surface 30*a* of diffuser nozzle 30 and carries with it said jet S2, so that frictional losses through feeding the driving water jet T along the inner wall surface 30*a* of nozzle 30 are avoided.

As a result of this guidance of the suction water and driving water and in particular due to the subdivision of the suction water into two jet sections S1 and S2, a very favourable flow profile (FIG. *2c*) is obtained compared with the flow profiles in the case of a central jet ejector (FIG. *2a*) and a circular jet ejector (FIG. *2b*). Furthermore, as a result of the integration of diffuser nozzle 30, into the suction or mixing section of the front engine part 11, a very short overall length of the engine is achieved, so that the latter can be used as a manoeuvering engine and in particular as a rotary manoeuvering engine even in very small ships. This favourable flow profile with respect to the present engine results from the avoidance of friction between the inner wall surface of the diffuser and the driving jet.

The embodiment shown in FIG. 3 has a filling body 40 which is axially symmetrical relative to the engine axis in diffuser inner area 36 for the purpose of regulating the outlet cross-section. Filling body 40 can be constructed in a displaceable manner in the direction of the engine axis, indicated by double arrow Y, by means of hydraulic, motor or mechanical devices. 401 indicates the filling body in the extended position.

Thus, between filling body 40 and diffuser inner wall 30*a* there is an annular outlet cross-section 41, whose surface area is determined by the position of filling body 40.

FIG. 4 shows another possible construction of the filling body and in this case 50 is a filling body which can be inflated in balloon-like manner and is axially symmetrical to the diffuser axis and which is fixed at its front end 52 and its rear end 53. The filling body can for example be inflated to the shape indicated by dotted lines at 501. Thus, the circular jet outlet cross-section 51 can be adjusted substantially at random by supplying or draining off the gaseous or liquid filling medium by means of a line not shown in the drawing.

Furthermore, in FIG. 5 it is possible to regulate the jet exit velocity of the engine by displacing the diffuser ring 30 in the direction of arrow Z. Thus, the inlet cross-section 35 available to the suction water jet S2 varies and consequently so does the quantity of the suction water supplied there. Thus, the ratio of driving water to suction water is changed and therefore so is the mixing jet velocity.

A further possibility of controlling the mixing ratio is provided according to FIG. 6 by regulating the central suction water jet S1, e.g. by arranging an inflatable filling body. Filling body 60 corresponds as regards construction and function to filling body 50 of FIG. 4. Filling body 60 can for example be inflated to the shape indicated by dotted lines at 601. If filling body 60 is arranged in such a way that the narrowest cross-section for suction water jet S1 is in the immediate vicinity of the rear end of the front engine part, i.e. just in front of the driving water nozzle, the additional advantage is obtained of reducing mixing losses, because then the suction water is fed into the driving water at a by no means negligible speed, resulting in a reduction of energy losses due to impact, which are a function of the speed difference between the driving water and the suction water.

The regulation of the diffuser outlet cross-section 32 by filling bodies arranged in the diffuser in accordance with the embodiments of FIGS. 3 and 4 necessarily increase the engine length. Thus, an important advantage of this engine compared to other ejector engines, i.e. the short overall length, is partly lost, which can be of decisive importance in connection with its use as a rotary manoeuvering engine. Thus, in the case of regulatable engines, in which due to the arrangement of filling bodies in the outlet cross-section and the connections of said filling bodies with the remainder of the engine a relatively large length is required, it is necessary to ensure that the other parts of the engine are made as short as possible.

One possibility is provided by shortening the diffuser. The diffuser length is determined by the maximum opening angle which, in the case of a simple diffuser 10, must not exceed 14°, because otherwise separations take place on the inner wall of the diffuser, thereby destroying its action. Therefore, an increase in the size of the diffuser opening angle is only advantageous if at the same time suitable measures are taken to ensure that no separation takes place.

The method of preventing separation by boundary layer suction is known. This principle can be used with particular advantage in the present case, as is shown in exemplified manner in FIG. 7. The diffuser part 70 of engine 10 is constructed, similar to the engine front part, as an annular duct 71. The inner wall 71*a*, i.e. the actual diffuser boundary surface, is perforated with a plurality of openings 72. The diffuser ring duct 71 is connected by means of a pipe 82 with a suction line 81 of a driving water pump 80. Thus, the pump takes part of its water requirement from the diffuser ring, whereby this part can be adjusted by means of valves 81*a* and 82*a*.

The size of the diffuser opening angle can be considerably increased as a result of the boundary layer suction simply achieved in the above indicated manner. In the case of a given ratio of the diffuser inlet surface to the diffuser outlet surface this permits a much smaller overall length than in the case of a simple diffuser.

A further possibility of increasing the diffuser opening angle is provided by imparting a swirling motion on the water flowing through the diffuser, so that the resulting centrifugal forces supply a positive pressure component to the inner surface of the diffuser which counteracts separation. The necessary swirling motion can be obtained by arranging corresponding swirl vanes both in the engine part and in the diffuser part. In addition, a swirling motion can be given to the driving water by arranging swirl vanes in the annular driving water nozzle. Although not shown in the drawing, it is also possible to arrange swirl vanes in the intake slot for the outer suction water jet S2 and in this case said vanes simultaneously serve as connecting members between the front and rear engine parts.

A still shorter construction of the manoeuvering engine is shown in FIG. 8. In principle, the system shown functions in exactly the same way as that of FIG. 7. The same components are given the same reference numerals. Only diffuser part 70 is replaced by the annular duct 90 having an approximately circular cross-section into which water is drawn through a slot. This firstly displaces rearwards the separation point on the annular body forming annular duct 90 and secondly induces an outwardly rotating ring vortex, so that the flow extension indicated by the arrows is obtained. The action therefore corresponds to that of a diffuser, whilst the total length is significantly reduced. In addition, the flow extension can to a certain extent be regulated by regulating the volume of water drawn through the inner area 91 of annular body 90 and consequently through slot 92. Here again, annular duct 90 is connected via pipe 82 with the suction line 81 of driving water pump 80, whilst 81*a* and 82*a* are valves.

A further constructional embodiment of the engine, which is also extremely short and permits a controllable jet expansion, is shown in FIG. 9. This variant is mainly of significance for rectangular engine cross-sections, particularly for fixed, non-rotary arrangements. In this case, the jet expansiion is achieved by driven rotors 200, 201, which rotate in opposite directions to one another as shown by the arrows. In FIG. 9, the flow produced is indicated by arrows. The degree of jet expansion can be controlled via the rotor speed.

If rotors 200, 201 rotate in the same direction, the same arrangement can bring about a deflection of the jet, as indicated by arrows in FIG. 10. This is naturally a considerable advantage in the case of fixed, non-rotary engines.

I claim:

1. Manoeuvering engine, for watercraft comprising an axially elongated engine having an axially extending front engine part and an axially extending rear engine part, said front engine part comprising an annular duct with the inner surface thereof forming an axially extending suction pipe having an inlet port at one end thereof and an outlet port at the opposite end thereof, said annular duct having an annular discharge slot located at and encircling the outlet port end of said suction pipe, said annular duct at the annular discharge slot being shaped to direct flow therefrom in a direction angularly outward relative to the axis of said suction pipe, said rear engine part comprises a diffuser nozzle overlapping the outlet port end of said annular duct and having an inlet port located at the outlet port end of said suction pipe and an outlet port spaced outwardly from said suction pipe, said inlet port into said diffuser nozzle having a smaller maximum diameter than the diameter of said outlet port thereof and the minimum diameter of said inlet port of said diffuser nozzle having a larger diameter than the diameter of said outlet port of said suction pipe, said inlet port being annular in shape laterally encircling said outlet port of said suction pipe and also encircling said annular discharge slot from said annular duct, said inlet port of said diffuser nozzle forming a suction water jet directed into said diffuser nozzle for spacing the flow from the said annular discharge slot so that it does not experience frictional contact with the inside wall surface of said diffuser nozzle, means for effecting optimum matching of the velocity of the mixing jet exiting from the engine to the speed of the watercraft comprising a device for regulating the cross section of flow through said engine comprising a filling body positioned within said diffuser nozzle and said filling body being axially symmetrical relative to the axis of said engine and having a conically shaped surface extending in the axial direction of said diffuser nozzle between said inlet and outlet ports thereof for forming an annular outlet cross section from said diffuser nozzle with said filling body being axially displaceable within said diffuser nozzle for varying the annular outlet cross section from said diffuser nozzle.

2. Manoeuvering engine, as set forth in claim 1, means for displacing said filling body in the axial direction of said engine.

3. Manoeuvering engine, as set forth in claim 1, said filling body being located in the outlet port from said suction pipe and extending in the axial direction of said engine into said suction pipe and into said diffuser nozzle.

4. Manoeuvering engine, as set forth in claim 1, wherein said diffuser nozzle being axially displaceable relative to said suction pipe for varying the cross section of said inlet port into said diffuser nozzle at the outlet port end of said suction pipe.

5. Manoeuvering engine, as set forth in claim 1, wherein said filling body is formed of a flexible expandible material arranged axially symmetrical with the axis of said engine and being spindle-shaped and inflatable with a gas or liquid in the manner of a balloon with the outer surface of said filling body and the surface of said diffuser nozzle at said outlet port therefrom form an adjustable annular outlet cross section dependent on the expanded volume of said inflatable filling body.

6. Manoeuvering engine, as set forth in claim 1, wherein said filling body is axially symmetrical to the axis of said engine and is spindle-shaped and inflatable with gas or liquid in the manner of a balloon, said filling body being formed of a flexible expandible material, said filling body being located in the outlet port from said suction pipe and extending axially into said suction pipe and into said diffuser nozzle and, in dependence on the extent to which said filling body is inflated, said filling body and said suction pipe at the outlet port end thereof form in combination an annular cross sectional passage variable in accordance with the extend of inflation of said filling body.

7. Manoeuvering engine, as set forth in claim 1, wherein said rear engine part comprises a second annular duct extending in the axial direction of said engine and encircling and forming the boundary of said diffuser nozzle within said rear engine part, said annular duct having an inner surface defining the boundary of said diffuser nozzle and said inner surface having openings therethrough communicating between said diffuser nozzle and the interior of said second annular duct, a line connected to and extending outwardly from the outer surface of said second annular duct, a regulating valve located in said line, a suction line connected to said line with a regulating valve positioned therebetween, a driving water pump connected to said line between said first and second regulating valves, said pump arranged to withdraw the boundary layer flowing through said diffuser nozzle through the openings in the inner surface of said second annular duct into said second annular duct and said line.

8. Manoeuvering engine, as set forth in claim 1, wherein swirl vanes are located in one of said front engine part or in said diffuser nozzle of said rear engine part.

9. Manoeuvering engine, as set forth in claim 1, wherein said diffuser nozzle comprises a diffuser part, said diffuser part comprises a second annular duct having an approximately circular cross section, said second annular duct having a side facing away from the outlet end of said front engine part with a slot in said side facing away with said slot directed toward said engine axis, whereby water can be drawn through said slot into the interior of said second annular duct, a driving water pipe connected to said second annular duct, a regulating valve located in said driving water pipe, a second regulating valve located in said pipe outwardly from said first regulating valve, a suction line extending from said second regulating valve outwardly from said second annular duct, so that by an appropriate adjustment of said first and second regulating valves the amount of water drawn through the annular slot in said second annular duct is adjustable and the expansion of the jet discharged from said engine can be regulated.

10. Manoeuvering engine, as set forth in claim 1, wherein said diffuser nozzle comprises a diffuser part, said diffuser part comprising a first and a second driven rotor each located tangentially of the jet flowing through said engine, said first and second rotors being rotatable in opposite directions at the location of contact with the jet flowing through said engine and rotating in the direction of flow of the jet so that the expansion of the jet can be regulated by controlling the speed of said first and second rotors.

11. Manoeuvering engine, as set forth in claim 1, wherein said diffuser nozzle comprises a diffuser part, said diffuser part comprises a first and a second driven rotor with said rotors being arranged tangentially of the jet flowing through said engine, said rotors being rotatable in the same direction for regulating the expansion of the jet flowing through said engine by controlling the speed of said first and second rotors.

12. Method of producing thrust in manoeuvering engines for watercraft in which, according to the drag jet principle, driving water and suction water are supplied to a front engine part and a following rear engine part of the engine, and characterized by the steps of subdividing the suction water into a first and a second flow portion, introducing the first flow portion as a suction water jet into an inlet port at one end of an axially elongated chamber within the front engine part and flowing the first flow portion to an outlet port spaced axially from the inlet port through a passage within the chamber having an increasing cross-sectional area toward the outlet port, forming the rear engine part as an axially extending diffuser nozzle in axial alignment with and extending axially outwardly from the outlet port of the chamber forming the front engine part with the inner surface of the rear engine part diverging in the direction outwardly away from the outlet port of the front engine part, overlapping the rear engine part over the outlet from the front engine part and forming an annular passageway therebetween supplying driving water into an annular duct laterally enclosing the first flow portion of the suction water through the front engine part, introducing an annular driving water jet from the annular duct into the inlet end of the diffuser nozzle laterally enveloping the first flow portion exiting from the outlet of the chamber so that the annular driving water jet laterally surrounds the first flow portion exiting from the outlet port of the front engine part and flows outwardly toward the inside wall of the rear engine part, introducing the second flow part of the suction water in the form of an annular jet laterally enclosing the annular jet of the driving water at the inlet end of the diffuser nozzle and flowing the first flow portion and second flow portion of the suction water through the diffuser nozzle with the annular driving water jet located therebetween so that the annular jet of the second flow part spaces the annular jet of driving water from the inside wall of the rear engine part whereby frictional losses of the driving water annular jet are avoided along the inner wall of the rear engine part.

13. Mamoeuvering engine for watercraft operated in accordance with the drag jet principle, comprising an axially extending engine comprising a front engine part and a rear engine part, said front engine part comprising an axially extending suction duct, said suction duct being laterally defined by an annular wall forming an annular duct encircling said suction duct, said suction duct having an inlet end and an outlet end and having an increasing diameter in the direction of the outlet at least in the region of the outlet end, said annular duct having an annular slot at the outlet end of said suction duct through which driving water exits therefrom with said annular slot encircling the outlet end of said suction duct and being shaped to direct flow angularly outwardly relative to the axis of said suction duct, said rear engine part comprises a diffuser nozzle encircling and extending axially from the outlet end of said suction duct, said diffuser nozzle overlapping the outlet end of said suction duct and having an inlet port at the end thereof encircling the outlet port of said suction duct and an outlet port at the opposite end thereof spaced outwardly from said suction duct, said inlet port of said diffuser nozzle being annular and having a smaller maximum diameter than the diameter of the outlet port of said diffuser nozzle and said inlet port of said diffuser nozzle having a minimum diameter greater than the maximum diameter of said outlet port of said suction duct, said inlet port of said diffuser nozzle laterally encircling said outlet port of said suction duct and forming an annular intake slot between the outer surface of said annular duct and the inner surface of said diffuser nozzle at said inlet port thereof whereby said annular intake slot laterally encircles said annular discharge slot from said annular duct so that a suction water jet can flow into said diffuser nozzle through said annular intake slot laterally bounding the outer surface of the annular flow of driving water from said discharge slot from said annular duct so that the suction water jet spaces the annular flow of driving water from the inside surface of said diffuser nozzle whereby frictional losses of the driving water are worked along the inside surface of said diffuser nozzle.

* * * * *